US007093341B2

(12) United States Patent
Gens

(10) Patent No.: US 7,093,341 B2
(45) Date of Patent: Aug. 22, 2006

(54) METHOD OF MAKING AN AXIAL PISTON PUMP BARREL WITH A CAST HIGH PRESSURE COLLECTION CAVITY

(75) Inventor: Thomas D. Gens, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/678,823

(22) Filed: Oct. 3, 2003

(65) Prior Publication Data

US 2004/0064943 A1 Apr. 8, 2004

Related U.S. Application Data

(62) Division of application No. 09/995,884, filed on Nov. 28, 2001, now Pat. No. 6,682,315.

(51) Int. Cl.
*B23P 17/00* (2006.01)
*F04B 1/12* (2006.01)

(52) U.S. Cl. ..... 29/527.5; 29/527.6; 29/888.02; 164/132; 164/137; 164/340

(58) Field of Classification Search ..... 29/527.5, 29/527.6, 888.02, 888.022, 888.023, 888.024, 29/888.025, 888.047, 888.072, 888.077; 164/132, 137, 340
See application file for complete search history.

(56) References Cited

U.S. PATENT DOCUMENTS 1,047,378 A * 12/1912 Bush ..... 29/894.012
3,459,253 A * 8/1969 Woolcott ..... 164/36
3,785,751 A 1/1974 Nemoto et al.
3,808,659 A 5/1974 Alger, Jr. et al.
3,857,243 A 12/1974 Douglas
3,864,801 A * 2/1975 Nakayama et al. .... 29/888.061
3,904,318 A 9/1975 Born et al.
3,918,515 A * 11/1975 Shiina ..... 164/137
3,991,811 A * 11/1976 Diez et al. ..... 164/121
4,040,597 A * 8/1977 Pierson et al. ..... 249/134
4,125,931 A * 11/1978 Pierson et al. ..... 29/559
4,237,847 A 12/1980 Baugh et al.
4,360,321 A 11/1982 Copp, Jr. et al.
4,437,389 A 3/1984 Kline
4,552,197 A * 11/1985 Mills ..... 164/34
4,757,857 A * 7/1988 Henkel ..... 164/137
4,776,075 A * 10/1988 Kawabata et al. ..... 29/888.047
4,779,666 A * 10/1988 Ruhlandt et al. ..... 164/120
4,891,875 A * 1/1990 Soichi et al. ..... 29/888.046
5,014,658 A * 5/1991 Hara et al. ..... 123/193.6
5,048,604 A * 9/1991 Vadasz F. et al. ..... 166/106
5,062,480 A * 11/1991 Chacin U. et al. ..... 166/108
5,131,466 A * 7/1992 Chacin U. et al. ..... 166/105

(Continued)

FOREIGN PATENT DOCUMENTS

EP 92690 A1 * 11/1983

(Continued)

*Primary Examiner*—Essama Omgba
(74) *Attorney, Agent, or Firm*—Liell & McNeil

(57) ABSTRACT

In an axial piston pump, a plurality of reciprocating pistons are at least partially positioned within a barrel. The barrel includes a ring shaped high pressure collection cavity that is positioned between the piston chambers and the outlet of the pump. In order to minimize potential loses due to leakage from the ring shaped collection cavity the barrel is made from a casting that utilizes a ring shaped core supported in a mold. This facilitates the formation of the ring shaped cavity while insuring location and dimensional tolerances, and assisting in the latter machining of the casting to its final form.

17 Claims, 5 Drawing Sheets

U.S. PATENT DOCUMENTS 5,391,058 A 2/1995 Goto et al.
5,737,838 A * 4/1998 Niimi et al. ..... 29/888.047
5,771,955 A * 6/1998 Helgesen et al. ..... 164/9
6,003,588 A * 12/1999 Dang et al. ..... 164/137
6,035,828 A 3/2000 Anderson et al.
6,119,580 A * 9/2000 Sato et al. ..... 92/12.2
6,206,080 B1 * 3/2001 Ji ..... 164/332
6,406,271 B1 6/2002 Valentin
6,464,473 B1 10/2002 Blass et al.
6,527,039 B1 * 3/2003 Shade ..... 164/137
6,527,040 B1 * 3/2003 Singer et al. ..... 164/137
6,533,020 B1 * 3/2003 Shade ..... 164/137
6,557,455 B1 * 5/2003 Keyster et al. ..... 92/71
6,598,655 B1 * 7/2003 Newcomb et al. ..... 164/28
6,615,901 B1 * 9/2003 Kaminski et al. ..... 164/137
6,682,315 B1 * 1/2004 Gens ..... 417/269

FOREIGN PATENT DOCUMENTS

EP 1 193 394 A2 10/2001
GB 2248569 A * 4/1992
JP 63252658 A * 10/1988
JP 01075163 A * 3/1989
JP 02255265 A * 10/1990

* cited by examiner

METHOD OF MAKING AN AXIAL PISTON PUMP BARREL WITH A CAST HIGH PRESSURE COLLECTION CAVITY

RELATION TO OTHER PATENT APPLICATION

This application is a division of Ser. No. 09/995,884, filed Nov. 28, 2001, now U.S. Pat. 6,682,315.

TECHNICAL FIELD

The present invention relates generally to axial piston pumps, and more particularly to a barrel casting for an axial piston pump having a ring shaped high pressure collection cavity.

BACKGROUND

Co-owned U.S. Pat. No. 6, 035,828 to Anderson et al. describes a hydraulically actuated system having a variable delivery fixed displacement axial piston pump. This pump is referred to as a fixed displacement because the swash or drive plate has a fixed angle such that each piston reciprocates a fixed distance and displaces a fixed amount of fluid with each rotation of the drive plate. The pump achieves a variable delivery by utilizing sleeves that surround each piston and cover a spill port for at least a portion of each reciprocation of the individual piston. For instance, if the sleeves are positioned at one location, the spill ports in the pistons remain uncovered throughout each reciprocation such that the pump merely circulates fluid between low pressure areas and no high pressure output is produced. When the sleeves are in another position, the spill ports are closed over the entire reciprocation distance of the piston such that the maximum high pressure output of the pump is achieved. The sleeves can be positioned anywhere between these two extremes via an electro-hydraulic control unit so that the effective high pressure delivery of the pump can be varied and controlled at will.

While this pump has shown considerable promise, there remains room for improvement. For instance, each of the pistons has one end received in a piston bore of a barrel component. A high pressure collection cavity is located between the barrel and the outlet of the pump. In addition, at least one check valve separates the individual piston chambers from the high pressure collection cavity. In the Anderson et al. pump, these various features are located in body components that are different from the barrel. As such, the effectiveness of the pump has the potential for compromise due to leakage between these components. In addition, insuring the proper location and orientation of these body components relative to one another can add substantial machining costs and assembly complications.

The present invention is directed to one or more of the problems set forth above.

SUMMARY OF THE INVENTION

In one aspect, a barrel assembly for an axial piston pump includes a casting that defines a ring shaped collection cavity that is fluidly isolated from a central bore.

In another aspect, a pump includes a barrel assembly mounted in a housing. The barrel assembly includes a casting that defines a ring shaped cavity fluidly isolated from a central bore, and a plurality of parallel piston bores that are open to the ring shaped cavity. A piston is slidably received in each of the piston bores. A drive plate have a slanted drive surface is rotatably mounted in the housing and operably coupled to each of the pistons.

In still another aspect, a method of making a barrel assembly for a pump includes a step of casting metal around a ring shaped core. The ring shaped core is then removed from the casting.

DETAILED DESCRIPTION

Figure 1:
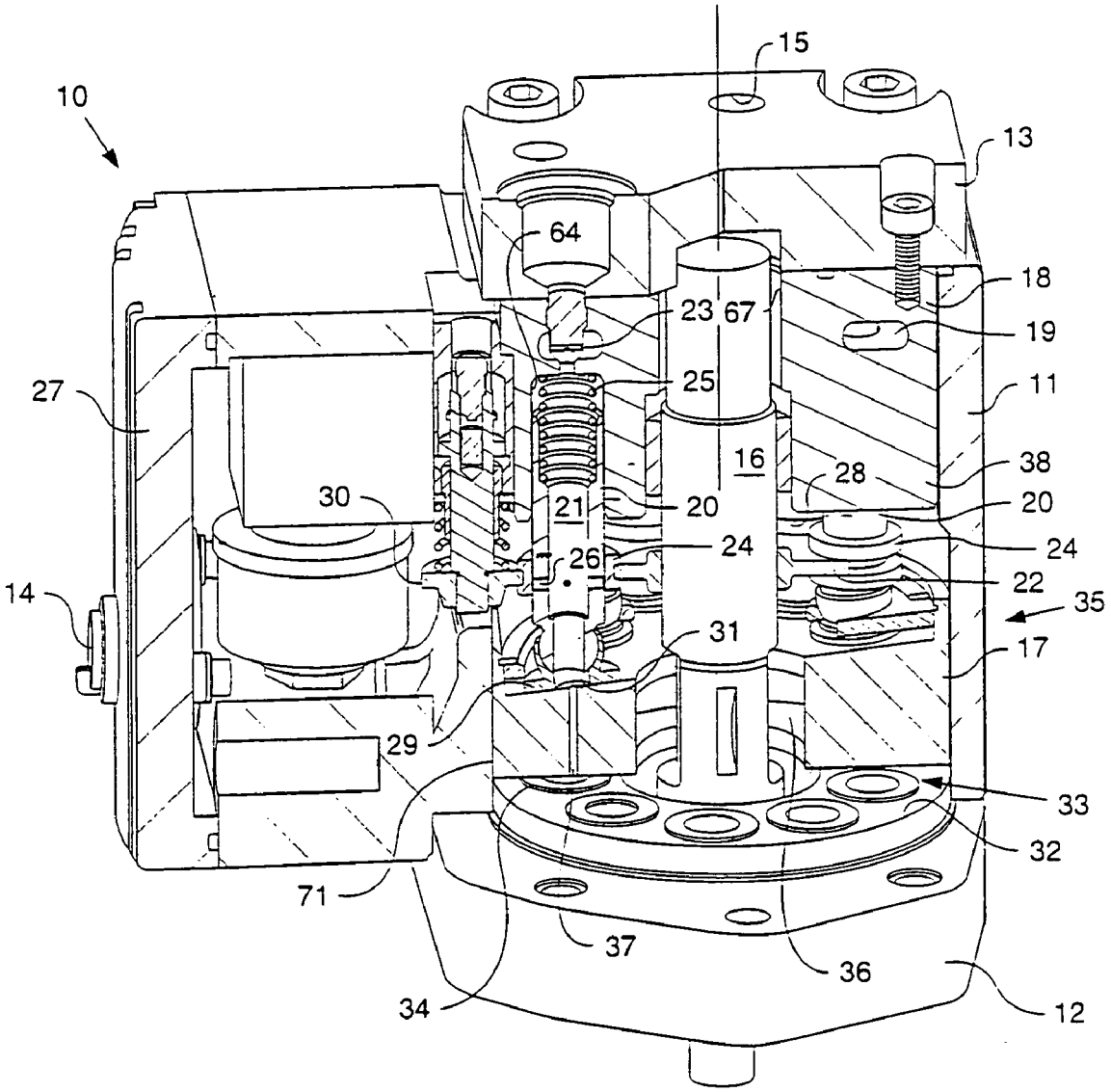
FIG. 1 is a partially sectioned isometric view of a pump according to a preferred embodiment of the present invention.

Referring to FIG. 1, there is shown an axial piston pump 10 according to the present invention. Pump 10 includes a housing 11 that includes a front flange 12 and an end cap 13. Housing 11 includes an inlet 14 and an outlet 15. When pump 10 is installed as part of a hydraulic system, such as a hydraulically actuated fuel injection system, inlet 14 is connected to a source of low pressure fluid, such as engine lubricating oil. Outlet 15 would be fluidly connected to a high pressure reservoir, such as a high pressure common rail that supplies working fluid to hydraulic actuators, such as those associated with hydraulically actuated fuel injectors and/or hydraulically actuated gas exchange valves, and the like. Pump 10 includes a drive shaft 16 having an external end that is coupled to an appropriate rotational power source, such as the crank shaft of an internal combustion engine. Drive shaft 16 preferably has a keyed connection to rotate a drive plate 17, which preferably has a fixed slant angle.

A plurality of pistons 20 are distributed around a centerline of the pump and oriented parallel to one another and to drive shaft 16. In the illustrated embodiment, there are preferably seven pistons; however, those skilled in the art will appreciate that a pump having any number of pistons could be suitable for use in relation to the present invention. Each individual piston 20 defines a hollow interior 21, and is aftached via a ball joint to a shoe 29 that is maintained in contact with drive plate 17 via the continuous urging of a return spring 25. Rotation of drive plate 17 causes the plurality of pistons to serially reciprocate between up and down positions, displacing fluid in a conventional manner. Each of the pistons 20 also includes a hollow interior 21, which can be thought of as a portion of that pistone pumping chamber, and at least one spill port 26 distributed around the periphery of the piston and opening into hollow interior 21. One end of each of the pistons is slidably received in a plunger bore 64 defined by a barrel assembly 18. Together, plunger bore 64 and hollow interior 21 define the pumping chamber for the individual piston. This pumping chamber is separated from a ring shaped high pressure collection cavity 19 in barrel assembly 18 by a check valve 23. In other words, the plunger bore 64 for each piston is separated from ring shaped collection cavity 19 by a separate check valve 23. Ring shaped collection cavity 19 is fluidly connected to outlet 15 via a passage that is not shown, but fluidly isolated from a central bore 67.

The output of pump 10 is controlled by an electro-hydraulic control unit 27 that is operable to move a control piece 30 up and down along a line that is parallel to that of the pistons. In particular, electro hydraulic control unit 27 moves a control piece 30, which is operably coupled to a plurality of sleeves 24 via a connector 22. An individual sleeve 24 is positioned around each individual piston 20. The location of sleeves 24 relative to spill ports 26 determines how much of the fluid displaced by piston 21 is pushed into high pressure collection cavity 19 or merely recirculated into low pressure interior 28 of the pump housing 11. In other words, if sleeve 24 maintains spill port 26 covered during the entire reciprocation distance of a piston 20, virtually all of the fluid displaced is pushed past check valve 23 into high pressure ring shaped cavity 19. On the other hand, if sleeves 24 are positioned such that spill ports 26 remain open as piston 20 is moved for its pumping stroke, the fluid displaced by piston 20 merely spills back into low pressure area 28 via spill ports 26 for recirculation.

When pistons 20 are undergoing their retracting stroke low pressure fluid is drawn into hollow interior 21 from low pressure pump interior 28 via a center filled inlet 36 in drive plate 17 and an internal fill passage and slot (not shown) that communicates with an opening 31 in shoes 29 at an appropriate rotational position that is out of plane in the sectioned view of FIG. 1. In addition to defining the fill passageway, drive plate 17 also defines a plurality of bearing supply passages 37 that communicate fluid from hollow interior 21 to the thrust pads 33 adjacent the underside of drive plate 17 to provide a hydrostatic thrust bearing 34. A portion of this fluid migrates up the outer radial wall of drive plate 17 to provide a hydrodynamic journal bearing 35. It should be noted that bearing supply passages 37 are positioned such that they only communicate with openings 31 when the individual piston 20 is undergoing its pumping stroke. When the pistons are undergoing their retracting stroke, they align with a fill slot (not shown) that is fluid communication with center fill inlet 36.

Figure 2:
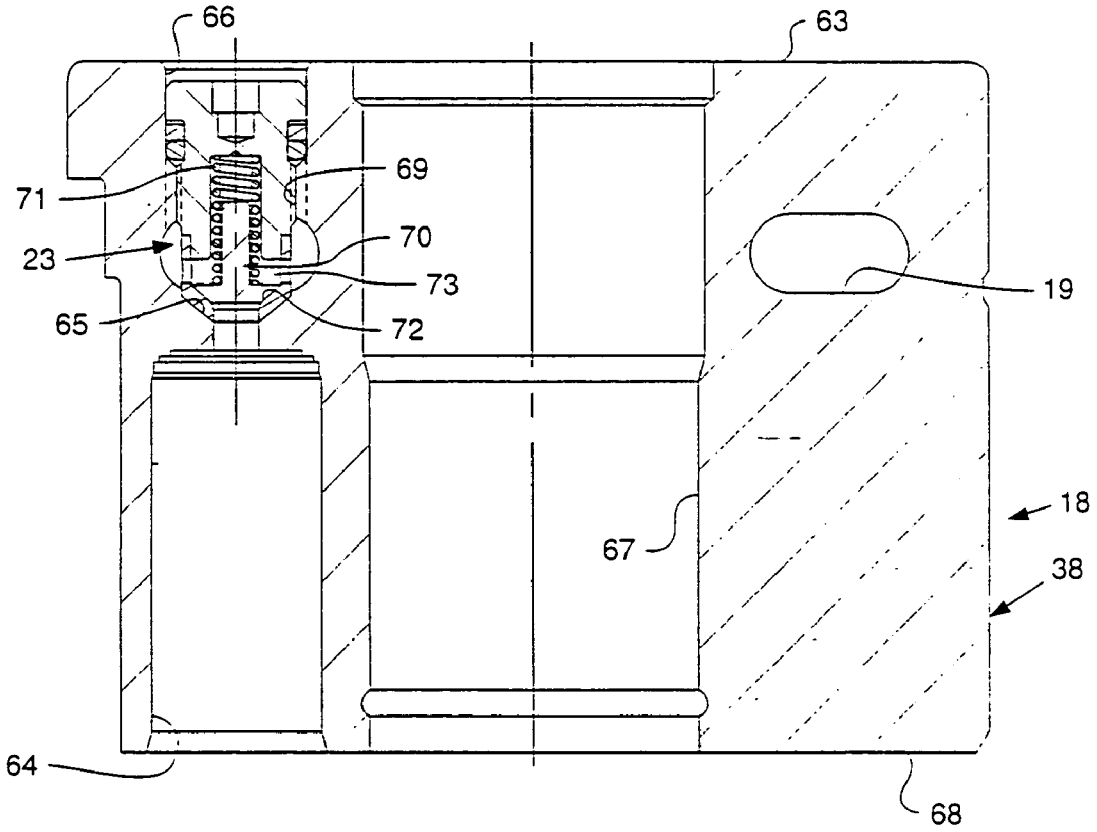
FIG. 2 is a sectioned side diagrammatic view of a barrel assembly according to the present invention.

Referring now to FIG. 2, the barrel assembly 18 is shown in greater detail. Barrel assembly 18 includes a machined casting 38 and a plurality of attached check valves 23. Unlike some alternative designed axial piston pumps, barrel assembly 18 of pump 10 remains stationary when the pump is in operation. Those skilled in the art will appreciate that in other axial piston pumps the barrel is rotated by the drive shaft and the drive plate remains stationary. The present invention is compatible with both types of axial piston pumps. As identified earlier, barrel casting 38 includes a ring shaped high pressure collection cavity 19 that is separated from piston bores 64 by a relatively short passage that includes a conical valve seat 65. Each of the check valves 23 includes external threads that mate to internal threads 69 that are machined in access openings 66 in barrel casting 38. Thus, check valves 23 are threaded into a position in contact with conical seat 65. Each check valve 23 includes a check valve member 70 that is biased into a position in contact with a seat 72 via a biasing spring 71. When in this biased position, a passage 73 is closed to piston bore 64. When fluid pressure pushing on check valve 70 exceeds the pre-load of biasing spring 71. check valve member 70 lifts to fluidly connect ring shaped collection cavity 19 to piston bore 64 via passage 73. Barrel casting 38 also includes a shaft support opening or central bore 67 that extends between first end 63 and second end 68. Central bore 67 is fluidly isolated from ring shaped cavity 19.

Figure 3:
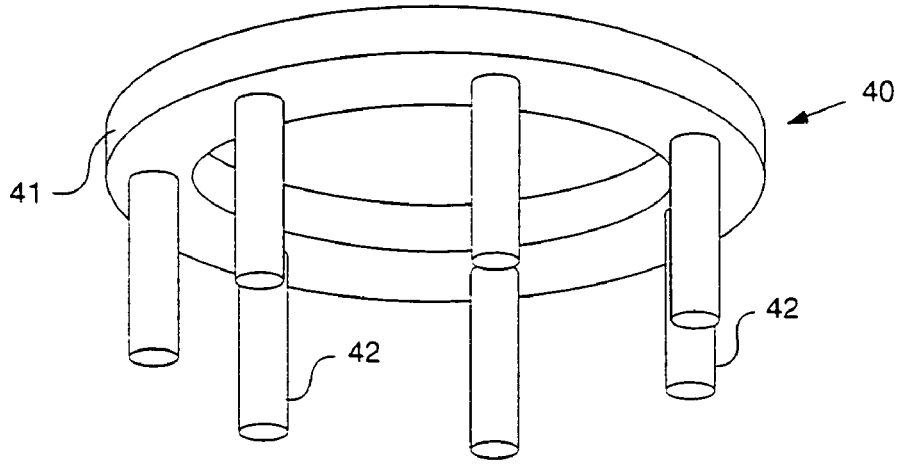
FIG. 3 is an isometric view of a ring shaped core according to one aspect of the present invention.
Figure 4:
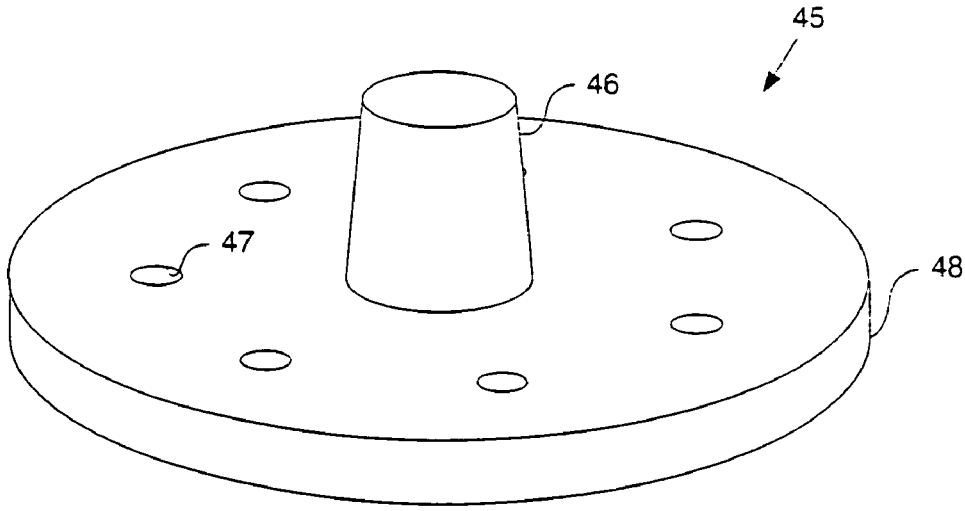
FIG. 4 is an isometric view of a base core according to another aspect of the present invention.
Figure 5:
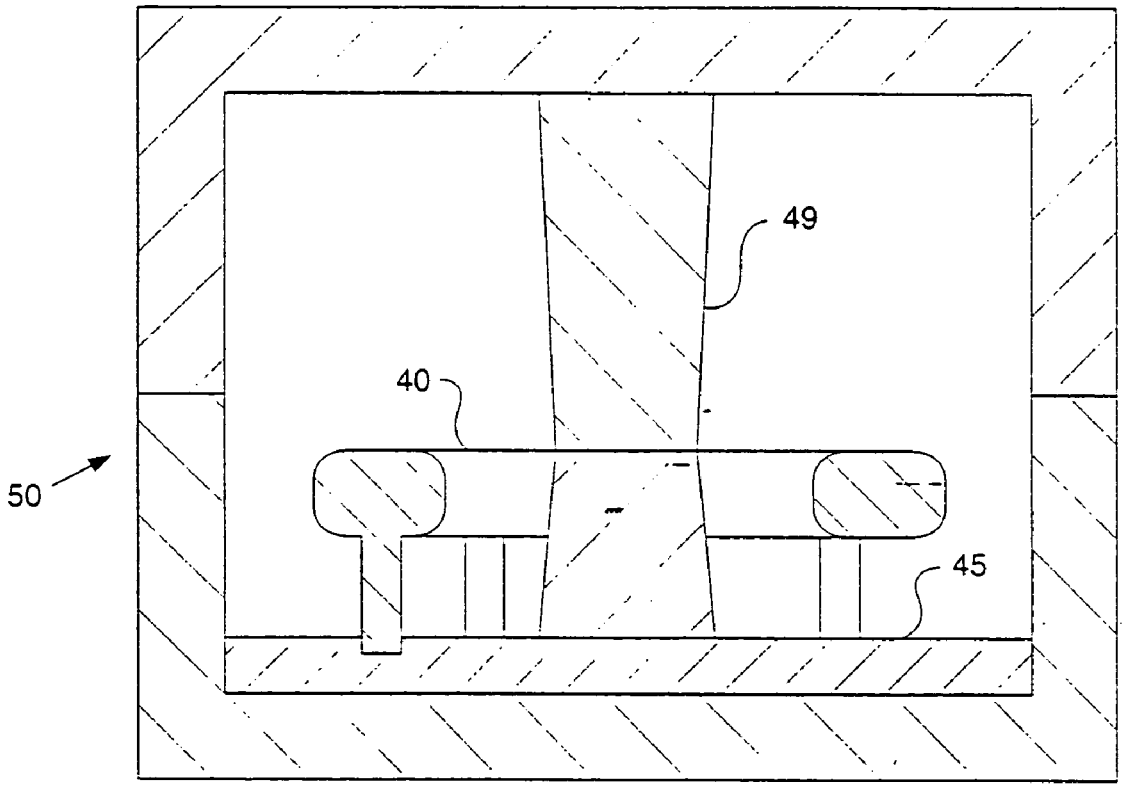
FIG. 5 is a sectioned side view of a casting mold according to another aspect of the present invention.

Referring now to FIGS. 3, 4, and 5, the various core pieces and mold assembly are illustrated to show how the barrel is casted to include its ring shaped collection cavity 19 (FIGS. 1 and 2). The barrel is preferably cast in a sand mold using discardable core pieces that are preferably premanufactured using a sand epoxy mixture in a conventional manner. In particular, ring shaped core 40 includes a ring shaped portion 41 and a plurality of pillars 42 that correspond to the number of pistons in the pump. A base core 45 is-likewise preferably manufactured from a suitable sand and epoxy mixture to include a central bore core 46 centrally located atop a base portion 48 that defines a plurality of pillar holes 47. An additional central bore core 49 (FIG. 5) can also be used in molding the barrel casting. When placed in mold 50, the pillars 42 of ring shaped core 40 are received in respective pillar bores 47 in base core 45. This arrangement insures that ring portion 41 will remain at its desired location when the molten metal is poured into mold 50. In other words, this mating arrangement between ring shaped core 40 and base core 45 insures that the pillars 48 are properly located in the cast component and that ring portion 41 is precisely located within mold 50 and remains at that location throughout the molding process.

Figure 6:
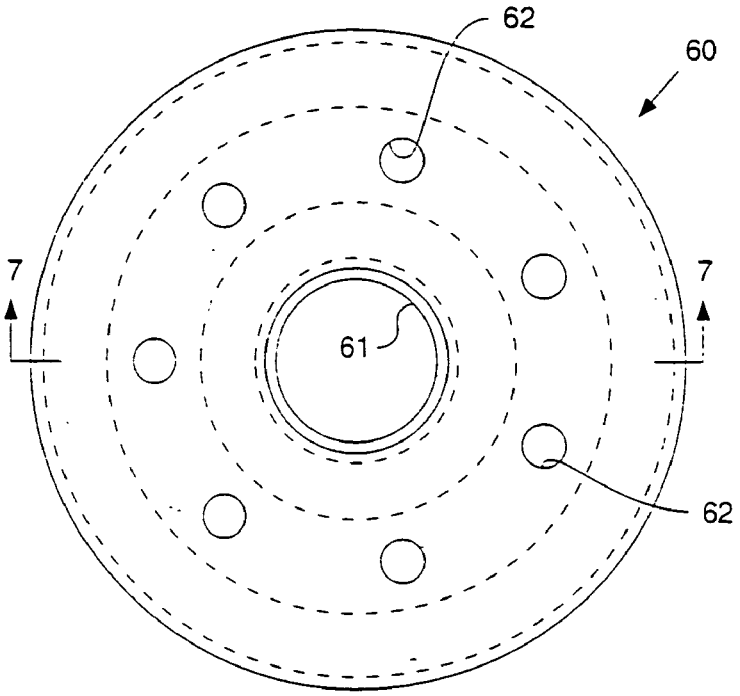
FIG. 6 is a top view of a casting blank according to one aspect of the present invention.
Figure 7:
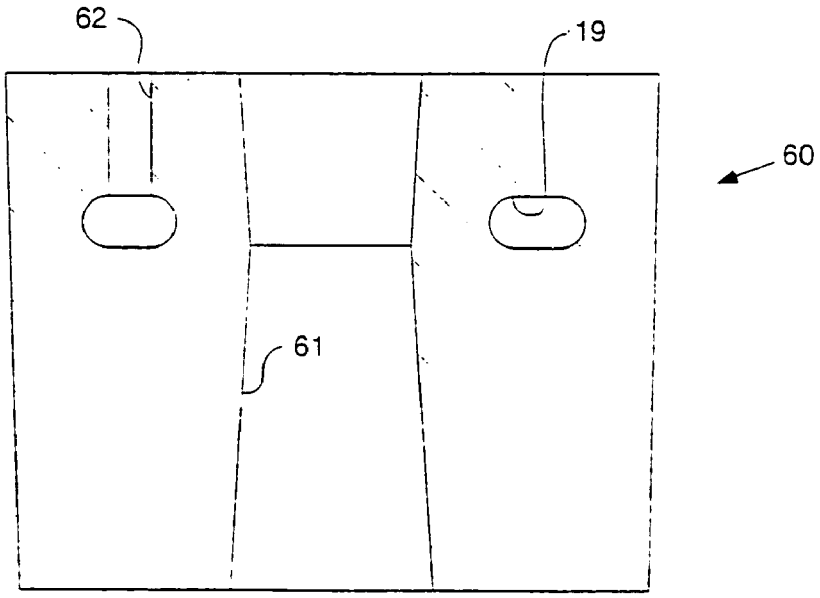
FIG. 7 is a sectioned side view of the casting blank of FIG. 5 as viewed along sectioned line 6—6.

Referring now in addition to FIGS. 6 and 7, a casting blank 60 is illustrated as would be produced using the mold 50 as illustrated in FIG. 5. Casting blank 60 includes a central bore 61, a plurality of pillar openings 62 and ring shaped high pressure collection cavity 19. This casting blank is then machined using conventional techniques to arrive at the barrel casting 38 shown in FIG. 2. During the machining process, the individual pillar openings 62 are enlarged to produce access openings 66, internal threads 69 and conical seats 65.

INDUSTRIAL APPLICABILITY

The present invention finds potential application in any case where there is a desirability to cast a cavity into a casting, especially when it is important to maintain a certain geometry for the cavity and precisely locate the same with regard to the other surface features of the component. In the present case, the casting technique of the present invention allows for the formation of a high pressure ring shaped cavity that is virtually free of potential leakage concerns that could become associated with pumps that utilize one or more joined components to form their high pressure cavity(s). The present invention also exploits that fact that the core for the ring shaped cavity can be located and supported using other attached core components that are located at or near where openings are intended to be located in the finished component. This allows the casting technique to exploit the anticipated location of access openings 66 (FIG. 2) in order to help facilitate the formation of internal ring shaped cavity 19. Furthermore, by combining this technique with the particular structure and attachment strategy of check valves 23 allows the individual check valves to provide the check valve functionality while sealing ring shaped collection cavity 19 from any leakage to the outside in a cost effective and efficient manner.

Returning to FIGS. 1 and 2, when in operation, pump 10 can preferably produce between zero and its maximum output depending upon the positioning of electro hydraulic control unit 27 and hence sleeves 24. As drive shaft 16 rotates, drive plate 17 rotates to cause each of the pistons 20 to reciprocate. Those undergoing their retracting stroke drawl fresh low pressure fluid from low pressure interior 28 through central fill inlet 36 and on to opening 31 via a passage in drive plate 17 not visible in FIG. 1. The pistons undergoing their pumping stroke push fluid out of piston bore 64 and hollow interior 21 past check valve 23 into high pressure collection cavity 19 for whatever portion of the piston stroke that sleeve 24 covers spill ports 26. For that portion of the pumping stroke in which spill ports 26 are open, the fluid is merely displaced back into low pressure interior 28. However, when spill ports 26 are closed, a portion of the fluid displaced by piston 20 is pushed down through bearing supply passages 37 to produce the hydrostatic fluid bearing that separates drive plate 17 from thrust bearing pads 34.

The above description is intended for illustrative purposes only, and is not intended to limit the scope of the present invention in any way. For example, the casting technique of the present invention could permit for the formation of more than one ring shaped cavity and possibly permit the usage of a single check valve as opposed to an individual check valve for each of the reciprocating pistons. Thus, those skilled in the art will appreciate the other aspects, objects and advantages of this invention can be obtained from a study of the drawings, the disclosure and the appended claims

What is claimed is:

1. A method of making an axial piston pump barrel, comprising the steps of:

positioning a central bore core in a mold;

positioning a ring shaped core in the mold to encircle the central bore core;

pouring metal around the ring shaped core and the central bore core to produce a casting in which a central bore defined by the central bore core is fluidly isolated from a cavity defined by the ring shaped core; and removing the ring shaped core from the casting wherein the step of positioning a ring shaped core in the mold includes supporting said ring shaped core in the mold atop a plurality of pillars, the plurality of pillars corresponding to a number of pistons in the pump.

2. The method of claim 1 wherein said removing step includes a step of breaking said ring shaped core into smaller pieces.

3. The method of claim 1 including a step of machining a plurality of parallelly oriented openings in the casting.

4. The method of claim 1 including a step of attaching a plurality of check valves to the casting.

5. The method of claim 4 including a step machining a conical valve seat for each of said plurality of check valves.

6. The method of claim 1 wherein the central bore core extends across the mold such that the casting has a central bore completely therethrough.

7. The method of claim 6 wherein the central bore core positioning step includes a step of contacting a first central bore core with an additional central bore core within the mold.

8. A method of making an axial piston pump barrel, comprising the steps of:

positioning a central bore core in a mold;

positioning a ring shaped core in the mold to encircle the central bore core;

pouring metal around the ring shaped core and the central bore core to produce a casting in which a central bore defined by the central bore core is fluidly isolated from a cavity defined by the ring shaped core;

removing the ring shaped core from the casting;

supporting said ring shaped core in the mold atop a plurality of pillars; and forming said ring shaped core to include a ring portion and the plurality of pillars extending away from said ring portion parallel to one another.

9. The method of claim 8 including a step of mating said plurality of pillars to counterpart pillar bores in a base core.

10. A method of making an axial piston pump barrel, comprising the steps of:

positioning a central bore core in a mold;

positioning a ring shaped core in the mold to encircle the central bore core;

pouring metal around the ring shaped core and the central bore core to produce a casting in which a central bore defined by the central bore core is fluidly isolated from a cavity defined by the ring shaped core;

removing the ring shaped core from the casting;

attaching a plurality of check valves to the casting;

machining a conical valve seat for each of said plurality of check valves; and wherein said attaching step includes a step of positioning each of said check valves in contact with one of said conical valves seats.

11. A method of making an axial piston pump barrel, comprising the steps of:

positioning a central bore core across a mold;

supporting a ring shaped core in the mold to encircle the central bore core via a plurality of support separated from the central bore core;

pouring metal around the ring shaped core and the central bore core to produce a casting in which a central bore defined by the central bore core extends through the casting;

removing the ring shaped core from the casting; and attaching at least one check valve into the casting in fluid contact with a ring shaped cavity left by the ring shaped core.

12. The method of claim 11 wherein the supporting step includes supporting the ring shaped core atop a plurality of pillars oriented in parallel with the central bore core; and the attaching step includes a step of locating a check valve in each void left by each of the plurality of pillars.

13. The method of claim 12 including a step of maintaining a position of the ring shaped core during the pouring step at least in part by receiving one end of each of the plurality of pillars in a respective pillar bore.

14. The method of claim 11 including a step of forming a plurality of piston bores at locations around, and parallel to, the central bore, and each piston bore opening into a ring shaped cavity left by the ring shaped core.

15. The method of claim 14 including a step of machining a conical valve seat into a surface that defines the ring shaped cavity; and contacting the valve seat with the check valve.

16. The method of claim 15 wherein the supporting step includes supporting the ring shaped core atop a plurality of pillars oriented in parallel with the central bore core;

the conical valve seat machining step includes a step of machining a conical valve seat into the surface that defines the ring shaped cavity adjacent each of the piston bores; and the attaching step includes a step of attaching a check valve in each void left by each of the plurality of pillars in contact with a respective one of the conical valve seats.

17. The method of claim 16 including a step of maintaining a position of the ring shaped core during the pouring step at least in part by receiving one end of each of the plurality of pillars in a respective pillar bore.

* * * * *